United States Patent [19]

Nicely

[11] Patent Number: 4,750,626

[45] Date of Patent: Jun. 14, 1988

[54] REMOVABLE CONICAL CORNER STRUCTURE FOR SHELVING

[75] Inventor: Charles W. Nicely, Dallas Township, Luzerne County, Pa.

[73] Assignee: United Steel & Wire Company, Battle Creek, Mich.

[21] Appl. No.: 820,529

[22] Filed: Jan. 17, 1986

[51] Int. Cl.[4] ..... A47B 47/00

[52] U.S. Cl. ..... 211/187; 108/111

[58] Field of Search ..... 211/187, 208; 108/110, 108/111, 144, 107

[56] References Cited

U.S. PATENT DOCUMENTS

| | | | |
|---|---|---|---|
| 3,675,598 | 7/1972 | Kesilman et al. . | |
| 4,128,064 | 12/1978 | Chung et al. . | |
| 4,230,052 | 10/1980 | Champagne | 211/187 X |
| 4,237,798 | 12/1980 | Welsch et al. | 108/144 X |
| 4,257,333 | 3/1981 | Pollack | 108/144 |
| 4,318,352 | 3/1982 | Friedman et al. | 108/111 |
| 4,582,001 | 4/1986 | Leikarts | 211/187 X |
| 4,592,286 | 6/1986 | Trubiano | 211/187 X |
| 4,615,278 | 10/1986 | Cabrelli . | |
| 4,637,323 | 1/1987 | Nicely | 211/187 X |

FOREIGN PATENT DOCUMENTS 855715 5/1940 France .

24353 12/1894 United Kingdom .

*Primary Examiner*—Ramon O. Ramirez
*Assistant Examiner*—Blair Johnson
*Attorney, Agent, or Firm*—Flynn, Thiel, Boutell & Tanis

[57] ABSTRACT

A corner structure, specifically for a shelving unit, which is formed by three one-piece members. The first member comprises a plastic sleeve having an external conical configuration, the sleeve being axially split throughout its length to facilitate elastic spreading so that it can be moved transversely into surrounding gripping engagement with a post. The second member involves a channel-like corner piece which is preferably welded directly to a shelf adjacent a corner thereof, this corner piece defining an arcuate channel which permits it to snugly embrace one side of the plastic sleeve. The third member comprises a strap which also has a channel adapted to embrace an opposite side of the plastic sleeve. The strap and corner piece having cooperating wedge structures which lockingly join the strap and corner piece together to effectively define a closed collar having an internal conical bore which is maintained in snug clamping engagement with the exterior conical surface of the plastic sleeve. The second and third members are held together solely by the wedged relationship created therebetween.

11 Claims, 4 Drawing Sheets

REMOVABLE CONICAL CORNER STRUCTURE FOR SHELVING

FIELD OF THE INVENTION

This invention relates to shelving and, more specifically, to improved adjustable shelving having a removable conical corner structure which facilitates the mounting on or removal of a shelf relative to the corner post.

BACKGROUND OF THE INVENTION

Adjustable shelving units employing shelves constructed of sheet metal or wire are well known and extensively utilized, and such shelving units are normally referred to as knock-down shelving since they are intended to be readily assembled and disassembled. For this purpose, the shelving unit normally utilizes a corner structure for securing the shelves to upright posts. In situations where strength and rigidity of the assembled shelving unit is of significance, the corner structure generally employs a sleeve or collar arrangement which totally surrounds the corner post to achieve a secure and rigid clamping engagement with the post to prevent what is commonly referred to as "racking". Such corner structure, however, not only makes assembly of the shelving unit more complex since the sleeve or collar must be slidably inserted over the post from one end, but this corner structure also makes partial disassembly or rearrangement of the shelves more difficult. For example, with most known shelving units employing a corner structure of this type, the corner structure does not permit a bottom or intermediate shelf (that is, a shelf located between upper and lower shelves) to be mounted on or removed from the post after the shelving unit has been assembled due to the inability to position a corner structure in surrounding relationship to the post.

A known shelving unit of the above type which has achieved significant commercial success provides a sleevelike corner structure which telescopes downwardly over the post, and a conical clamping sleeve which is normally diametrically split into two pieces and is wedgingly interposed between the collar and post. This arrangement, wherein the intermediate conical clamping sleeve is utilized, has proven desirable inasmuch as this positively ensures a positive wedging and hence secure engagement of the shelf with respect to the post so as to provide an extremely strong connection which hence tends to minimize looseness or "racking". The shelving units employing this intermediate conical sleeve, however, have still normally possessed features which have been considered undesirable with respect to the required assembly and disassembly techniques, the inability to add or remove intermediate shelves, and the general overall structural and functional complexities associated with some of the collar structures.

Accordingly, it is an object of this invention to provide an improved adjustable shelving unit, specifically a metal shelving unit, having an improved corner structure coacting between the shelves and the corner posts, which corner structure permits and retains the utilization of a intermediate conical clamping sleeve interposed between the post and the corner collar, but at the same time this improved corner structure overcomes many of the disadvantages associated with prior shelving units of this general type. More specifically, the improved corner structure of this invention facilitates the assembly and disassembly of the shelves, including the assembly or disassembly of an intermediate shelf with respect to an assembled shelving unit, and permits the corner structure to be efficiently and economically fabricated while at the same time providing not only greatly increased flexibility but also providing a compact corner structure having a desirable appearance when assembled into the shelving unit.

More specifically, this invention relates to an improved corner structure, as aforesaid, which is formed basically by three one-piece members. The first member comprises a plastic sleeve having an external conical configuration, the sleeve being axially split throughout the length thereof to facilitate its elastic spreading so that it can be moved transversely into surrounding gripping engagement with the post. The second member involves a channel-like corner piece which is preferably welded directly to the shelf adjacent a corner thereof, this corner piece defining an arcuate channel which permits it to snugly embrace one side of the plastic sleeve. The third member comprises a strap which also has a channel adapted to embrace an opposite side of the plastic sleeve, the strap and corner piece having cooperating wedge structures which lockingly join the strap and corner piece together so as to effectively define a closed collar having an internal conical bore which is maintained in snug clamping engagement with the exterior conical surface of the plastic sleeve. The second and third members are held together solely by the wedged relationship created therebetween, which relationship involves a pair of flangelike wedges on opposite sides of the strap, and a pair of wedgelike slots formed on opposite sides of the corner piece for individually receiving therein the flanges of the strap.

In the improved corner structure of this invention, as briefly described above, the three members cooperate with one another and with the post in such manner as to result in minimum cracks or crevices so as to permit utilization of the unit in environments requiring sanitary conditions. At the same time, the corner structure permits the shelf to be assembled onto or removed from the post in an easy and simple manner without requiring any special or complex tools, and without requiring the use of additional fasteners such as screws or the like, and which permits the complete corner structure to be engaged on or removed from the post wholly by moving all of the three members in a transverse direction with respect to the longitudinal axis of the post, whereby assembly or disassembly can be totally accomplished without requiring any of the parts to be telescoped over the length of the post. At the same time, the resulting corner structure, when assembled on the post, provides an extremely secure and tight clamping and supporting engagement of the shelf relative to the post.

Other objects and purposes of the invention will be apparent to persons familiar with structures of this general type upon reading the following specification and inspecting the accompanying drawings.

Figure 1:
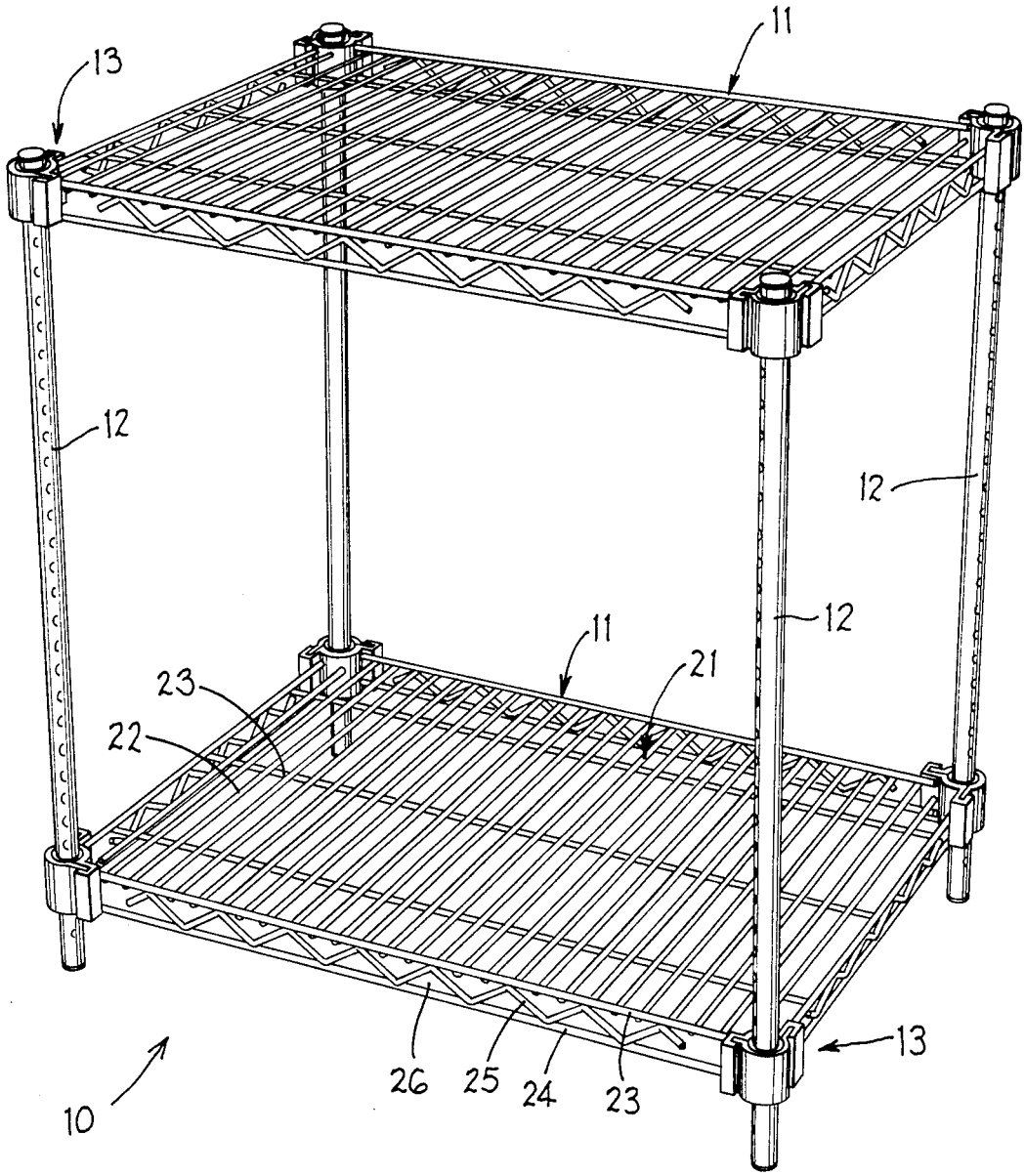
FIG. 1 is a perspective view of a shelving unit of this invention in an assembled condition.
Figure 2:
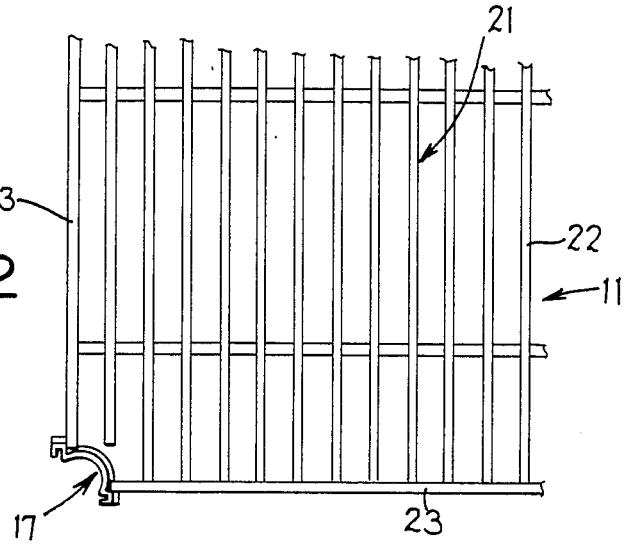
FIG. 2 is a top view showing a portion of the shelf.
Figure 3:
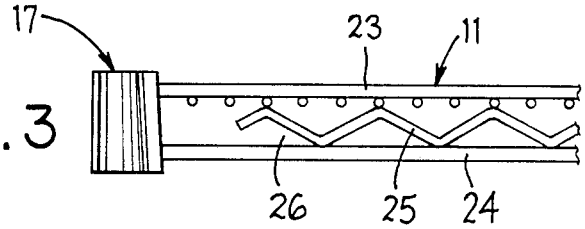
FIG. 3 is a front view showing the shelf illustrated by FIG. 2.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the shelving unit and designated parts thereof. Said terminology will include the words specifically mentioned, derivatives thereof, and words of similar import.

DETAILED DESCRIPTION

Referring to FIG. 1, there is illustrated an adjustable, knock-down shelving unit 10 according to the present invention. This shelving unit includes a plurality of substantially horizontal shelves 11 which are disposed in parallel but vertically spaced relationships. The shelves are supported by a plurality, here four, of upright corner posts 12. The corner of each shelf 11 is releasably attached to the respective corner post 12 by a separable corner structure 13.

The corner structure 13 of this invention is basically of a three-piece construction, and includes a first clamping member 16 (FIGS. 4 and 5) which shall hereinafter be referred to as the strap, a second clamping member 17 which shall hereinafter be referred to as the corner piece, and a third clamping member which shall hereinafter be referred to as the clamping or conical sleeve. Each of the members 16, 17 and 18 is preferably of a one-piece construction. The members 16 and 17 are adapted to be wedgingly coupled together to define a collar 19 for surrounding the post 12.

The construction of the shelf 11 is generally conventional in that it includes a substantially planar mat 21 formed from a plurality of parallel metal wires or rods 22 which are disposed in sidewardly spaced relationship and extend transversely across the width of the shelf. The mat wires 22 are fixedly secured to and supported on upper longitudinally extending wires or rods 23, which rods 23 are disposed adjacent the front and rear edges of the shelf. A further longitudinal wire 23 is also normally positioned to extend longitudinally under the center of the shelf to provide additional strength and reinforcement. Upper wire 23 and a parallel lower longitudinal wire 24 are rigidly secured together by means of a welded truss wire 25 extending therebetween so as to define a truss 26 which extends longitudinally along both the front and rear edges of the shelf. Similar such trusses are also fixedly secured to and extend along the side edges of the shelf. If necessary, a similar truss can also extend longitudinally along the longitudinal centerline of the shelf.

The post 12 comprises a vertically elongated channel, preferably a closed channel such as a tube. The post 12 preferably has a cylindrical tubular cross section to provide optimum strength and ease of usability and assembly. The post, conventionally of steel, is preferably provided with two rows of indentations or recesses 28, hereinafter referred to as dimples, formed therein, which rows of dimples 28 extend longitudinally of the post in generally parallel relationship with the longitudinal central axis 27 thereof, with these two rows of dimples being disposed on substantially diametrically opposite sides of the post. The dimples 28 within each row are preferably uniformly vertically spaced apart at relatively small increments, such as vertical spacings of about one inch, to permit the individual shelves to be vertically positioned at the desired elevations. While the dimples 28 are preferably formed merely by effecting a suitable deformation of the side wall of the tube so that the dimple hence comprises only a shallow recess, nevertheless it will be appreciated that the dimples could be replaced by holes which penetrate the tube wall if desired, or the dimples could even be replaced by annular grooves which totally surround the post. However, use of dimples is preferred in that they provide economy of manufacture and avoid creation of openings which extend totally through the wall of the post so as to prevent entry of contaminates and the like.

Figure 4:
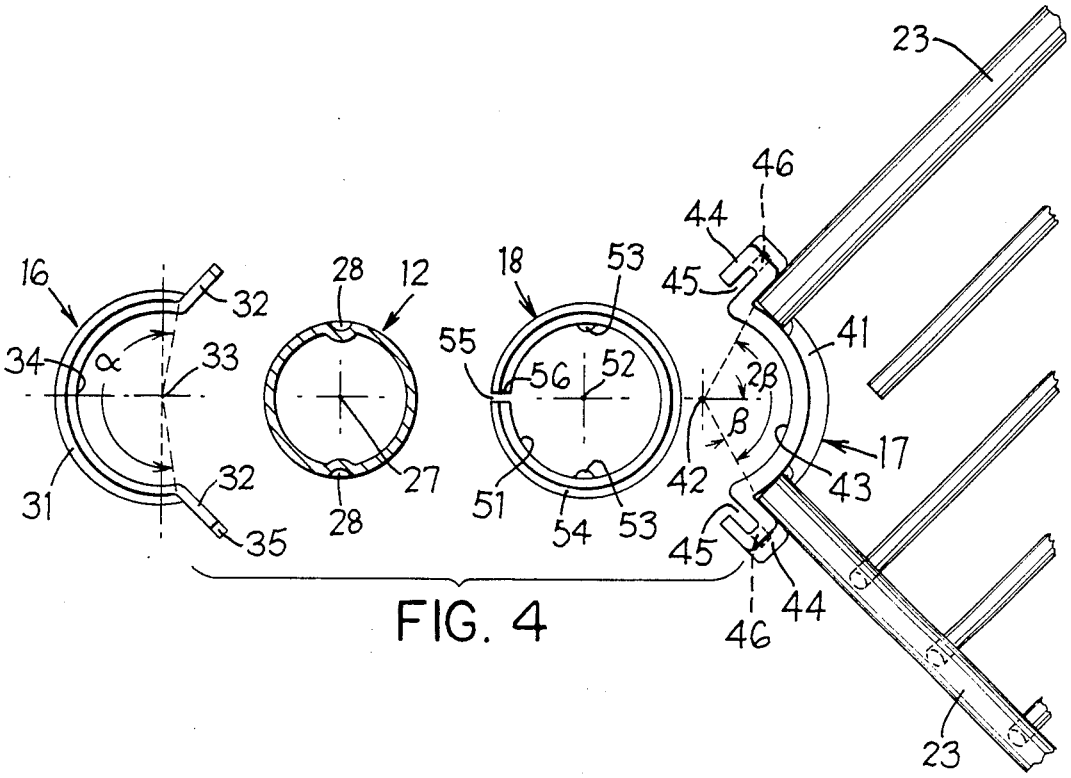
FIG. 4 is an exploded top view showing the positional relationship of the corner structure and its positional relationship relative to the post and the corner of the shelf.
Figure 5:
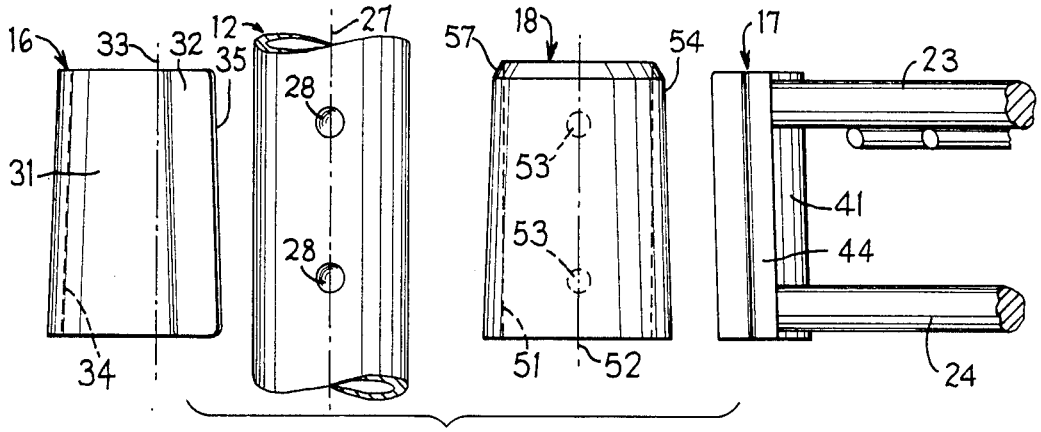
FIG. 5 is an elevational view corresponding to FIG. 4.
Figure 7:
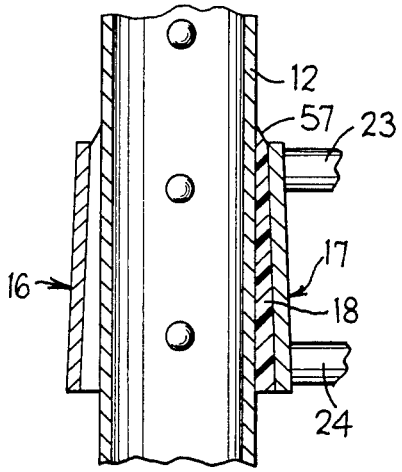
FIG. 7 is a central sectional view as taken substantially along line VII—VII in FIG. 6.

The members defining the corner structure 13 will now be considered in detail, and for this purpose reference is made specifically to FIGS. 4 and 5.

Considering first the strap 16, it includes a main or central part 31 which is of a generally channel-shaped configuration, and this main part 31 is provided with flanges 32 projecting outwardly or sidewardly from the edges thereof. The strap 16, including both the main part 31 and the flanges 32, is of substantial axial extent, and in fact is normal of an axial length which approximately equals or slightly exceeds the depth of the shelf 11. The main or center part 31 is of a generally arcuate configuration which is effectively generated about a center axis 33, the latter extending vertically and being adapted to overlie the longitudinal axis 27 of the post 12 when the corner structure is assembled. The generation of the center part 31 about the axis 33 results in the center part having a inner clamping surface 34 which, within a horizontal plane, defines a circular arc extending through an angle of at least 180°, and in fact the circular arc defining this inner clamping surface 34 preferably extends through an angle $\alpha$ which exceeds 180° by about 10 to 20 degrees, the angle $\alpha$in the illustrated embodiment being about 195°.

The inner clamping surface 34 of the strap 16 is provided with a slight slope or inclination as it projects downwardly, this inclination being outwardly away from the axis 33 so that the generating radius for the surface 34 at the bottom of the strap is greater than the generating radius for the surface 34 adjacent the top of this strap. The inclination or taper of this surface 34 relative to the axis 33 is normally only a matter of a few degrees, typically in the range of about one degree to about three degrees, and preferably about two degrees. This hence results in the inner clamping surface 34, if extended throughout a full 360°, defining a truncated conical surface.

The flanges 32 of the strap 16 are of uniform width (as measured outwardly away from the outer surface of the center part 31), whereby each flange 32 hence has an outer edge or surface 35 which slopes outwardly as it projects downwardly so as to generally extend parallel with a segment of the clamping surface 34, the edges 35 hence defining thereon wedging surfaces for a purpose to be explained hereinafter.

Figure 6:
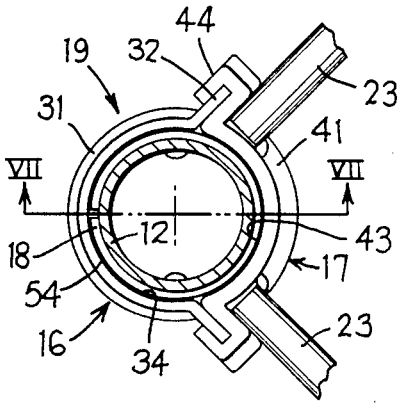
FIG. 6 is a top view illustrating the corner structure assembled between the shelf and post.
Figure 8:
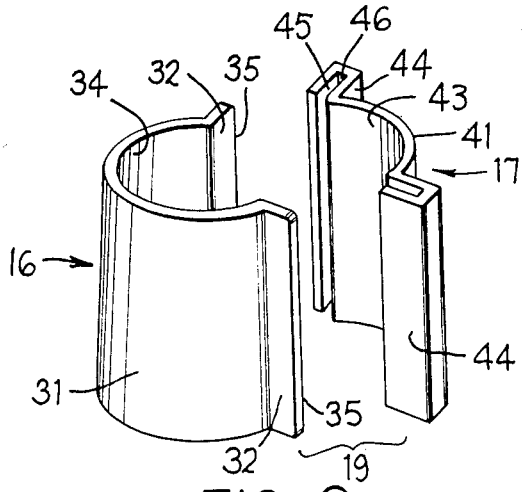
FIG. 8 is a perspective view which illustrates the two separable pieces which effectively define a corner collar for the shelf.

In this embodiment, the flanges 32 generally extend within vertical planes which are substantially perpendicular with respect to one another so as to hence extend generally parallel along the front and side faces of the shelf 11, substantially as illustrated in FIG. 6. Further, the orientation and positioning of the two flanges 32 results in the vertical planes defined by these flanges being disposed so as to extend parallel with but in nonintersecting relationship relative to the longitudinal axis 33.

The strap 16 is preferably formed from thin metal plate of uniform thickness, such as by means of a die stamping operation.

Considering now the corner piece 17, it also includes a main or central part 41 which is also of a generally channel-shaped configuration, with this channel-shaped center part 42 extending throughout the complete axial (that is vertical) length of the corner piece. This corner piece 17 has a vertical or axial length which substantially identically corresponds with the axial length of the strap 16.

The channel-shaped center part 41 is of an arcuate configuration which, within a horizontal plane, is generally circular and is generated on a radius about the longitudinal axis 42, the latter extending vertically. The channel-like center part 41 hence defines therein an inner clamping surface 43 which is of an arcuate concave configuration similar to that of the inner clamping surface 34 of the strap 16. The inner clamping surface 43, however, extends through an angle 2B which is preferably more than 90° but significantly less than 180°, the angle $\beta$ in the illustrated embodiment preferably being in the range of about 60° to about 70° whereby the angle 2B is hence in the range of 120° to 140°. Further, the radius generating this inner clamping surface 43 progressively increases axially from the top to the bottom of the clamping surface, in a manner identical to that of the clamping surface 34 of the strap 16, so that the inner clamping surface 43 of the corner piece hence slopes slightly outwardly as it projects downwardly, this slope or taper being identical to that associated with the clamping surface 34 of the strap. The clamping surfaces 34 and 43, when the strap and corner piece cooperate with one another, hence effectively define a substantially cylindrical surface which is tapered or inclined outwardly as it projects axially downwardly, whereby the resulting surface defined by the opposed surfaces 34 and 43 hence cooperate to define a truncated conical surface.

The corner piece 17 also includes a pair of flanges 44 which are integral with and project outwardly from the axially extending edges of the channel part 41. Each of these flanges 44 is of a generally U-shaped configuration oriented such that the free end of one of the parallel legs of the U is integrally joined to the respective axial side edge of the center channel 41, whereupon the U-shaped flange 44 thus defines between the legs thereof a narrow slot 45. This slot 45 extends axially throughout the length of the corner piece, and opens inwardly so as to generally intersect the imaginary circular profile generated by the clamping surface 43. The outer or other end of the slot 45 is closed by the bottom wall 46 of the U-shaped flange 44, which bottom wall 46 extends generally parallel with a segment of the tapered clamping surface 43 so that this surface 46 is also inclined or tapered at the same small angle as it projects axially downwardly. This bottom surface 46 hence functions as a wedging surface, with the two wedging surfaces 46 as defined by the pair of flanges 44 converging with respect to one another as they project axially upwardly. The slots 45 have a width which only slightly exceeds the thickness of the strap flanges 32 so that the latter flanges will be snugly and wedgingly accommodated within the slots 45.

The corner piece 17, like the strap 16, is preferably formed from a piece of flat metal plate of uniform thickness, the plate necessarily being of small thickness, with the flat metal plate being suitably deformed, such as by a multiple die stamping operation so as to permit formation of the center channel part and the U-shaped flanges.

The corner piece 17, as illustrated by the drawings, is preferably fixedly and permanently secured to the corner of the shelf 11, such as by welding the corner piece 17 to the shelf. This is most easily accomplished by sizing and positioning the corner piece such that the longitudinal wires 23 and 24 have the free ends thereof disposed directly behind the inner legs of the U-shaped flanges 44, with the wires 23 and 24 substantially abutting the exterior surface of the channel part 41, whereupon the wires 23 and 24 can then be suitably welded to the corner piece. However, other means can be provided if desired for fixedly attaching the corner piece to the shelf, although the preferred embodiment as illustrated by the drawings is believed to represent one of the more economical approaches.

The strap 16 and corner piece 17 are adapted to be axially slidably telescoped one into the other, such as by positioning the corner piece 17 over the strap and then moving the corner piece axially downwardly so that the flanges 32 on the strap slidably move upwardly into the slots 45. This relative axial movement occurs until the wedge surfaces 35 on the flanges 32 wedgingly contact the opposed wedge surfaces 46 formed on the bottoms of the flanges 44, whereby the strap 16 and corner piece 17 are hence axially wedged together and in effect create a continuous sleevelike corner. When the corner piece and strap are wedged together, the small slope or angle of the wedging surfaces is such as to effectively hold the two pieces together, and hence the strap 16 will not fall out of engagement with the corner piece 17 unless subjected to a downward impact, as by striking it with a mallet.

Concerning now the third corner member, namely the clamping sleeve 18, same is preferably constructed in one piece of a plastics material, and has an axial length which is only slightly greater than the axial length of the strap 16 and corner piece 17. The sleeve 18 has a cylindrical bore 51 extending vertically coaxially therethrough, this bore 51 being of uniform diameter throughout its axial length. The diameter of this bore 51, which is defined about the longitudinal vertically-extending axis 52 of the sleeve, is generally equal to the outer diameter of the post 12 when the sleeve is in a nondeformed condition.

The inner cylindrical wall defining the bore 51 has a plurality of small nubs or projections 53 which project radially inwardly through a small extent. The projections 53 are preferably disposed on diametrically opposite sides of the inner wall, with two such projections being disposed on each side at axially-spaced intervals corresponding to the axial spacing between the dimples 28 formed in the post 12.

Sleeve 18 has an outer annular surface 54 which is tapered or sloped outwardly as it projects downwardly, whereby the sleeve 18 hence has a wall thickness which progressively increases as the wall projects axially downwardly. The outer surface 54 hence defines an outer truncated conical configuration, and the slope or taper of this surface 54 is normally identical to the slope or taper defined by the surfaces 34 and 43, this slope preferably being 2° in the preferred embodiment.

To provide the sleeve 18 with greatly increased resilient deformability, the sleeve is preferably provided with a single slit or split 55 which extends radially through the complete width of the side wall and extends axially throughout the complete length thereof. This split 55, when the sleeve is in its normal position (that is, a nondeformed condition) normally results in the directly opposed axial edges 56 being circumferentially spaced a small distance apart. This hence permits limited inward elastic contraction of the sleeve so as to snugly clampingly engage the outer periphery of the post when the corner structure is clampingly engaged therewith. At the same time, this split 55 allows the sleeve 18 to be effectively opened up so that the opposed edges 56 are sufficiently spaced apart as to permit the post 12 to pass transversely therebetween into the bore 51, following which the sleeve 18 will elastically return to a substantially closed ringlike condition so as to snugly embrace the post 12.

The upper outer corner of the sleeve 18 is preferably chamfered or bevelled, as indicated at 57, so as to avoid the forming of a flat upwardly-facing surface which could function as a dirt or contaminate collecting surface. This also enables the upper chamfer 57 to effectively function as a camming surface so as to facilitate the downward movement of the shelf collar (as defined by the strap 16 and clamp piece 17) over the sleeve 18.

OPERATION

The assembly of the shelving unit 10 and specifically the assembly of the corner structure 13 will be briefly described to ensure a complete understanding thereof.

Assuming that the shelving unit is initially in a completely disassembled condition, then the strap 16 is initially axially slidably inserted upwardly into the respective corner piece 17 until the two pieces tightly wedge together. If necessary, the strap 16 can be tapped upwardly into the corner piece 17 by means of a mallet, although such is normally not required. When the strap 16 and corner piece 17 are assembled as described above, the strap 16 will normally remain locked to the corner piece so as to thus define a sleevelike collar 19 fixedly associated with the corner of the shelf 11.

The conical sleeve 18 is then positioned in surrounding relationship to the post 12. For this purpose, the sleeve 18 can be resiliently outwardly expanded at the split 55 so that the sleeve can be moved transversely over the post, with the sleeve then returning to its normally closed ringlike condition. The sleeve 18, so long as the projections 53 are not aligned with the dimples 28, can be slidably moved axially of the post to the desired location, whereupon the sleeve can then be rotated so that the projections align with and can snap into the dimples 28. This hence effectively axially secures the sleeve relative to the post.

Thereafter, the post 12 having the sleeve 18 thereon can be axially slidably inserted through the collar 19 associated with the corner of the shelf 11, which insertion occurs until the sleeve 18 is telescoped upwardly into the conical bore defined by the clamping surfaces 34 and 43. The post having the sleeve thereon is moved upwardly until the collar 19 is snugly seated on the exterior conical surface 54 of the sleeve, which snug seating also effectively clamps the sleeve 18 tightly against the outer surface of the post. Due to the small taper provided on the outside of the sleeve and the inside of the collar, specifically the 2° taper, the sleeve 18 and collar 19 tightly wedge together so as to securely couple the shelf to the post.

In a very similar manner, all four posts can be coupled to the shelf.

In the event that a shelf is to be mounted on an existing shelving unit which is already assembled, such as between upper and lower shelves, then the collar 19 is not preassembled. Rather, the sleeve 18 is moved transversely so as to be snapped onto the post. The strap 16 is positioned adjacent one side of the sleeve 18, the shelf having the corner piece 17 thereon is disposed upwardly adjacent the other side of the sleeve 18, and then is moved downwardly so as to wedgingly couple it to the strap 16 simultaneous with the creation of a conical wedging engagement around the sleeve 18. This operation may require more than one person to complete the assembly, but does permit a shelf to be wholly installed without requiring that any part be telescoped downwardly over the post. In a similar manner, an intermediate shelf can be wholly removed from the post by an operation which is substantially the reverse of the above described assembly operation.

MODIFICATION

Figure 9:
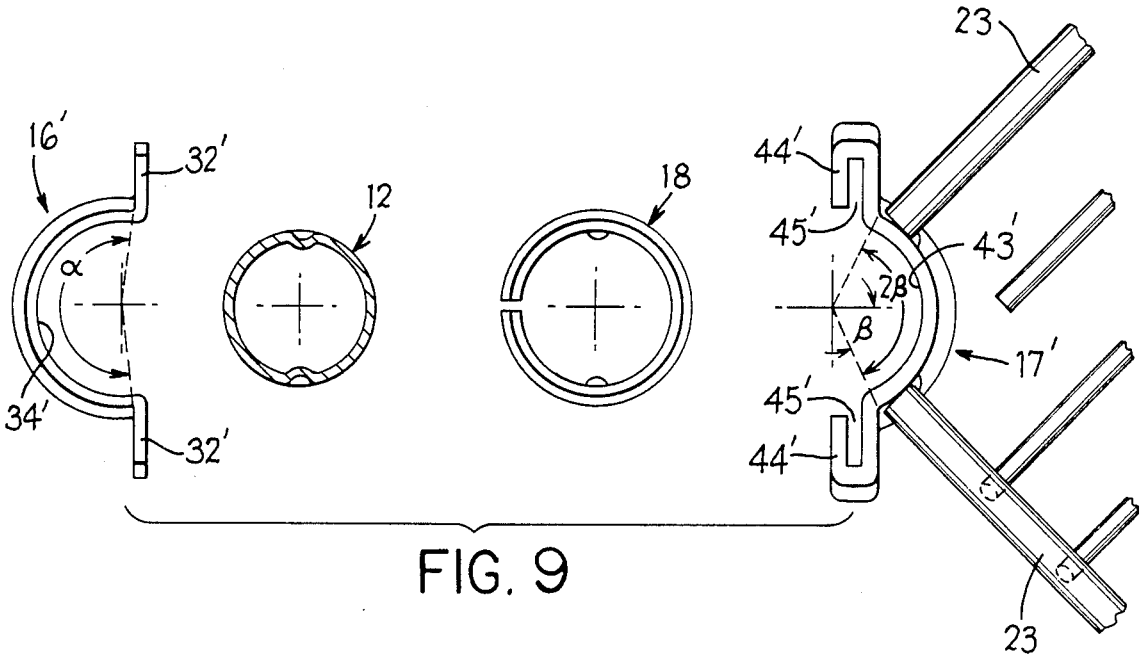
FIG. 9 is a view similar to FIG. 4 but illustrating a preferred variation of the invention.
Figure 10:
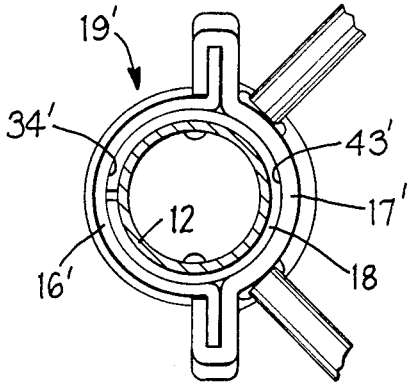
FIG. 10 is a view similar to FIG. 6 but illustrating the variation of FIG. 9 therein.

FIGS. 9 and 10 illustrate a modification of the corner structure, which modification is directed solely to the strap 16 and corner piece 17 which form the collar 19. In this modification, which is a preferred embodiment of the invention, the structure of the modified strap 16' and corner piece 17' are identical to their respective members 16 and 17 described above except that the flanges 32' on the strap 16' project outwardly and lie substantially within a single vertical plane, which plane is parallel to but spaced from the longitudinal axis of the arcuate clamping surface 34'. The U-shaped flanges 44' associated with the corner piece 17' also project directly outwardly from one another so that the slots 45' are disposed in directly opposed relationship to one another and lie substantially within a single vertical plane, which plane is parallel to but spaced from the vertical axis of the clamping surface 43'. Other than these differences, the strap 16' and corner piece 17' are otherwise identical to the respective pieces 16 and 17 described above.

The arrangement illustrated by FIGS. 9 and 10 structurally and functionally cooperates in the same manner as described above, so that further description thereof is believe unnecessary.

The arrangement illustrated by FIGS. 9 and 10 is preferred inasmuch as the flanges 32' and their confinement within the slots 45' results in the wedging forces which cooperate between the pieces 16' and 17', adjacent the opposite sides thereof, being directly opposed to one another so that the flanges 32' hence become very positively wedgingly locked within the slotted flanges 44' when the parts 16' and 17' are coupled together. This is believed to provide a more optimum and secure coupling of the parts, and in particular is believed to minimize distortion forces which may tend to distort or bend the flanges.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a shelving unit having at least one upright post, at least one shelf, and a corner structure coacting between said post and said shelf for stationarily but releasably securing said shelf to said post at a selected location therealong, comprising the improvement wherein:

said corner structure includes an axially-elongated sleevelike collar stationarily secured to one corner of said shelf and adapted to be disposed in surrounding relationship to the post, and an intermediate clamping sleeve concentrically interposed between said collar and said post for stationarily holding the shelf relative to the post;

said clamping sleeve being axially elongated and of an axial length similar in magnitude to that of said collar, said clamping sleeve having slit means extending axially thereof for enabling the sleeve to be radially compressed into snug clamping and surrounding engagement with the exterior wall of the post, said clamping sleeve having an axially elongated central bore projecting coaxially therethrough of a diameter similar to the exterior diameter of said post, said clamping sleeve having a substantially annular and axially elongated exterior wall which is of a substantially truncated conical configuration, said exterior wall as it projects downwardly being sloped outwardly at a small angle relative to the longitudinal axis of the post;

said clamping sleeve and said post having gripping means coacting therebetween for restricting axial movement of the clamping sleeve relative to the post; and said collar having an axially elongated opening extending therethrough and being defined by a substantially inner annular wall having a truncated conical configuration corresponding substantially to the conical configuration defined by the exterior wall of said clamping sleeve, said collar being disposed on and in surrounding relationship to the clamping sleeve so that the inner wall of the collar surrounds and clampingly engages the exterior wall on the clamping sleeve for clampingly compressing the clamping sleeve into snug gripping engagement with the post;

said collar being formed by first and second separable corner members which cooperate to define said collar, each of said corner members defining thereon an inner surface which extends through an arcuate extent substantially less than 360° and which forms a part of said inner wall, one of said corner members being stationarily attached to the corner of said shelf, the other corner member being totally detachable and removable from said one corner member, each of said corner members being of an open channel-like configuration so that each said corner member can be transversely moved toward and away from the post for engagement of disengagement relative to the post;

said collar including wedge means coacting between said first and second corner members for permitting the corner members to be locked together in surrounding relationship to the post and for permitting the corner members to be wholly separated from one another, said wedge means including a first pair of wedge parts fixedly associated with said first corner member adjacent opposite peripheral edges thereof and a second pair of wedge parts fixedly associated with the second corner member adjacent opposite peripheral edges thereof, said first and second wedge parts being axially slidably connectable for causing the first and second corner members to be joined together to define said collar;

said first corner member including an arcuate concave central part extending through an angle of at least 180° and terminating in a pair of platelike flanges which project generally radially outwardly from the opposite circumferentially-spaced edges of the arcuate central part, said flanges defining said first wedge parts;

said second corner member including an arcuate concave central part which extends through an angle significantly less than 180° and which terminates in a pair of channel-like flanges which project radially outwardly from said central part adjacent the opposite circumferentially spaced edges thereof, said channel-like flanges defining said second wedge parts and defining radially-inwardly opening slots for accommodating therein the platelike flanges of said first corner member; and said platelike flanges and said slots being axially elongated over a majority of the axial extent of said collar, said platelike and channel-like flanges having opposed wedge surfaces which extend at a small angle relative to said longitudinal axis so that the wedge surfaces are wedgingly engaged as the platelike and channel-like flanges are axially slidably moved one within the other to effect an axial and circumferential locking engagement between the first and second corner members, said channel-like flanges circumferentially restraining and confining the platelike flanges for preventing radial separation of the first and second corner members.

2. A shelving unit according to claim 1, wherein the slots defined by the pair of second flanges lie substantially within a single vertical plane which is generally parallel to but spaced sidewardly from said longitudinal axis.

3. A shelving unit according to claim 1, wherein said second corner member is fixedly and nonremovably attached to the corner of said shelf. as a one-piece unit from thin metal plate of substantially uniform thickness.

4. A shelving unit according to claim 1, wherein each of said first and second corner members is formed

5. A shelving unit according to claim 1, wherein the inner surface on said second corner member extends through an angle which exceeds 90° but is significantly less than 180°, and wherein said inner surface on said first corner member extends through an angle in the range of about 190° to about 200°.

6. A shelving unit according to claim 1, wherein said clamping sleeve is of a one-piece structure constructed of a plastics material, said slit means comprising a single slit which extends radially through the side wall of said clamping sleeve and axially throughout the complete length thereof so that the clamping sleeve can be radially expanded to permit it to be moved transversely over the post, said clamping sleeve having sufficient natural resiliency as to automatically contract into surrounding engagement with the post.

7. In a shelving unit having at least one upright post of circular cross section, at least one shelf, and a corner structure coacting between said post and said shelf for stationarily but releasably securing said shelf to said post, the improvement comprising:

said corner structure being formed by three one-piece members;

a first said member comprising an axially elongated one-piece plastic sleeve having an external truncated conical surface which slopes outwardly at a small angle relative to the longitudinal axis of the post as the conical surface projects downwardly, said sleeve having an axially elongated central bore projecting coaxially therethrough of a diameter similar to the exterior diameter of said post, the sleeve being axially split throughout its length to facilitate elastic spreading so that it can be moved transversely into surrounding gripping engagement with said post;

said plastic sleeve having gripping means which project radially inwardly thereof and coact with the post for restricting axial movement of the plastic sleeve relative to the post;

a second said member comprising a channel-like corner piece which is fixedly secured directly to said shelf adjacent a corner thereof, said corner piece defining an arcuate channel having a first inner surface for snugly embracing one side of said plastic sleeve; and a third said member comprising a strap having an arcuate channel defining thereon a second inner surface for snugly embracing an opposite side of said plastic sleeve;

said strap and said corner piece having a pair of cooperating wedge structures which lockingly join opposed adjacent free edges of said strap and corner piece together to define a closed collar having an internal truncated conical wall as defined by said inner surfaces which is maintained in snug clamping engagement with the external conical surface of said plastic sleeve, said second and third members being held together solely by the cooperating wedge structures, one of said first and second inner surfaces extending through an angle about said longitudinal axis which is in excess of 180°, and the other of said inner surfaces extending through an angle about said longitudinal axis which is significantly less than 180°.

8. A shelving unit according to claim 7, wherein said shelf is constructed of wire rods and includes longitudinal and transverse edge rods which extend in generally perpendicular relationship to one another, said longitudinal and transverse edge rods having adjacent ends thereof permanently and fixedly secured to said second member adjacent opposite edges of said channel, said pair of cooperating wedge structures including a pair of channel-shaped flanges which are fixed to opposite edges of the arcuate channel of said second member and define wedge-receiving grooves which open generally inwardly toward the post, and said pair of cooperating wedge structures including a pair of wedge-shaped flanges which are fixed to opposite edges of the arcuate channel of the third member and are snugly and wedgingly received within the channel-shaped flanges.

9. A shelving unit according to claim 8, wherein said channel-shaped flanges project outwardly in opposite directions from the respective arcuate channel so as to define a generally vertically extending plane which is spaced from but extends generally parallel with the longitudinal axis of the post, said vertical plane being arranged in intersecting relationship to the respective longitudinal and transverse edge rods which rigidly attach to the respective arcuate channel.

10. A shelving unit according to claim 8, wherein the channel-shaped flanges project outwardly from opposite edges of the respective arcuate channel in substantially perpendicular relationship to one another and are disposed directly adjacent and fixedly secured to the respectively adjacent longitudinal and transverse edge rods.

11. A shelving unit according to claim 8, wherein each of said second and third members is formed as a one-piece unit from metal plate of substantially uniform thickness, and wherein the inner surfaces on said second and third member have an outward and downward slope in the range of from about one and one-half degrees to about three degrees relative to said longitudinal axis.

* * * * *

UNITED STATES PATENT AND TRADEMARK OFFICE

CERTIFICATE OF CORRECTION

PATENT NO. : 4 750 626

DATED : June 14, 1988

INVENTOR(S) : Charles W. Nicely

It is certified that error appears in the above-identified patent and that said Letters Patent is hereby corrected as shown below:

Column 10, Line 1; Change "of disengagement" to ---or disengagement---.

Column 10, Lines 54 and 55; Delete "as a one-piece unit from thin metal plate of substantially uniform thickness.".

Column 10, Line 57; After "is formed" insert ---as a one-piece unit from thin metal plate of substantially uniform thickness.".

Signed and Sealed this

Fifteenth Day of November, 1988

*Attest:*

*Attesting Officer*

DONALD J. QUIGG

*Commissioner of Patents and Trademarks*